US009458546B2

(12) United States Patent
Amit

(10) Patent No.: US 9,458,546 B2
(45) Date of Patent: Oct. 4, 2016

(54) ARTICLES FROM MICROARC PROCESSES AND METHODS OF MANUFACTURING SAME

(75) Inventor: David Amit, Zur Yigal (IL)

(73) Assignee: PCT PROTECTIVE COATING TECHNOLOGIES LIMITED, Kadima (IL)

( * ) Notice: Subject to any disclaimer, the term of this patent is extended or adjusted under 35 U.S.C. 154(b) by 631 days.

(21) Appl. No.: 13/981,064

(22) PCT Filed: Jul. 6, 2011

(86) PCT No.: PCT/IB2011/052997

§ 371 (c)(1),
(2), (4) Date: Jul. 22, 2013

(87) PCT Pub. No.: WO2012/004753

PCT Pub. Date: Jan. 12, 2012

(65) Prior Publication Data

US 2014/0008231 A1 Jan. 9, 2014

Related U.S. Application Data

(60) Provisional application No. 61/361,539, filed on Jul. 6, 2010.

(51) Int. Cl.

| | |
|---|---|
| ***C25D 5/00*** | (2006.01) |
| ***C25D 7/04*** | (2006.01) |
| ***C25D 11/02*** | (2006.01) |
| ***C25D 11/04*** | (2006.01) |
| ***C25D 11/26*** | (2006.01) |
| ***C25D 11/30*** | (2006.01) |

(52) U.S. Cl.

CPC . *C25D 5/00* (2013.01); *C25D 7/04* (2013.01); *C25D 11/022* (2013.01); *C25D 11/026* (2013.01); *C25D 11/04* (2013.01); *C25D 11/26* (2013.01); *C25D 11/30* (2013.01)

(58) Field of Classification Search

CPC ..... C25D 7/04; C25D 11/026; C25D 11/04; C25D 11/26; C25D 11/30; C25D 11/022; C25D 5/00

See application file for complete search history.

(56) References Cited

U.S. PATENT DOCUMENTS

| | | | | |
|---|---|---|---|---|
| 5,720,866 | A * | 2/1998 | Erokhine et al. | 205/83 |
| 2010/0163421 | A1* | 7/2010 | Krishna | C25D 17/02 205/84 |

* cited by examiner

*Primary Examiner* — Kishor Mayekar
(74) *Attorney, Agent, or Firm* — Symbus Law Group, LLC; Clifford D. Hyra

(57) ABSTRACT

Disclosed articles as results of a microarc oxidation process, or plurality thereof, which are not limited by size, specifically by certain dimensions of their size, such as their length. Different sections or surfaces of articles of the invention may be subjected to a microarc oxidation process at any given time, such as by gradually subjecting a surface of an article to a microarc oxidation process, or such as by sequentially subjecting different sections of an articles to a microarc oxidation process. Furthermore, disclosed are methods for manufacturing of articles of the invention, or otherwise for subjecting articles of the invention to a microarc oxidation process, or plurality thereof. In some examples, tubes of above 6 meter in length may be coated according to methods of the invention. The coating of said tubes may be beneficial for desalination applications. In other examples, only grooves of pulleys are coated. Further disclosed are articles which underwent a microarc oxidation process, or plurality thereof, which included different solution, optionally by utilizing a solution modulator.

20 Claims, 4 Drawing Sheets

FIG. 2A
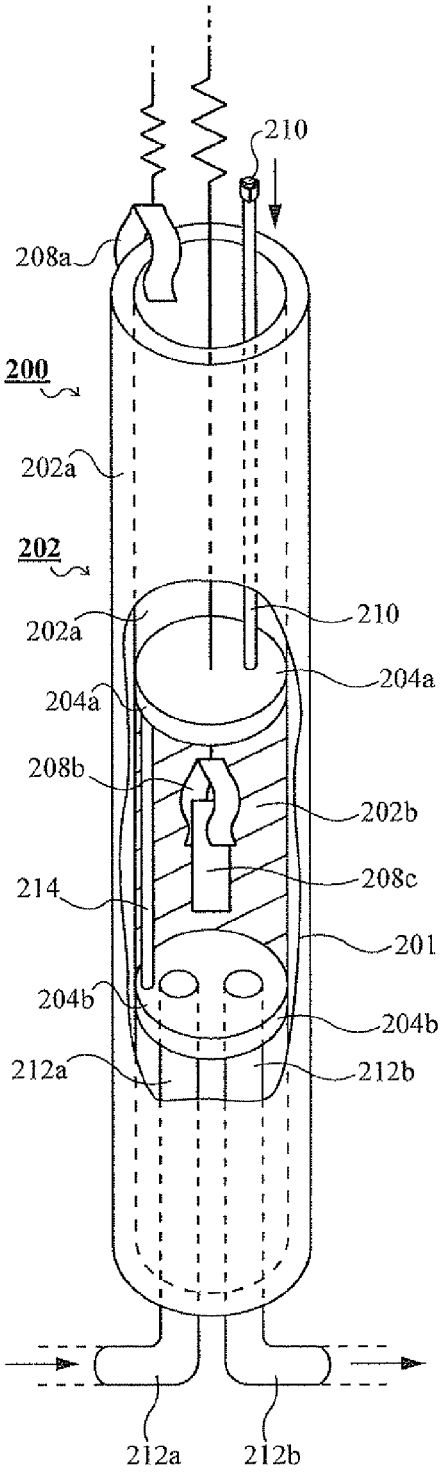
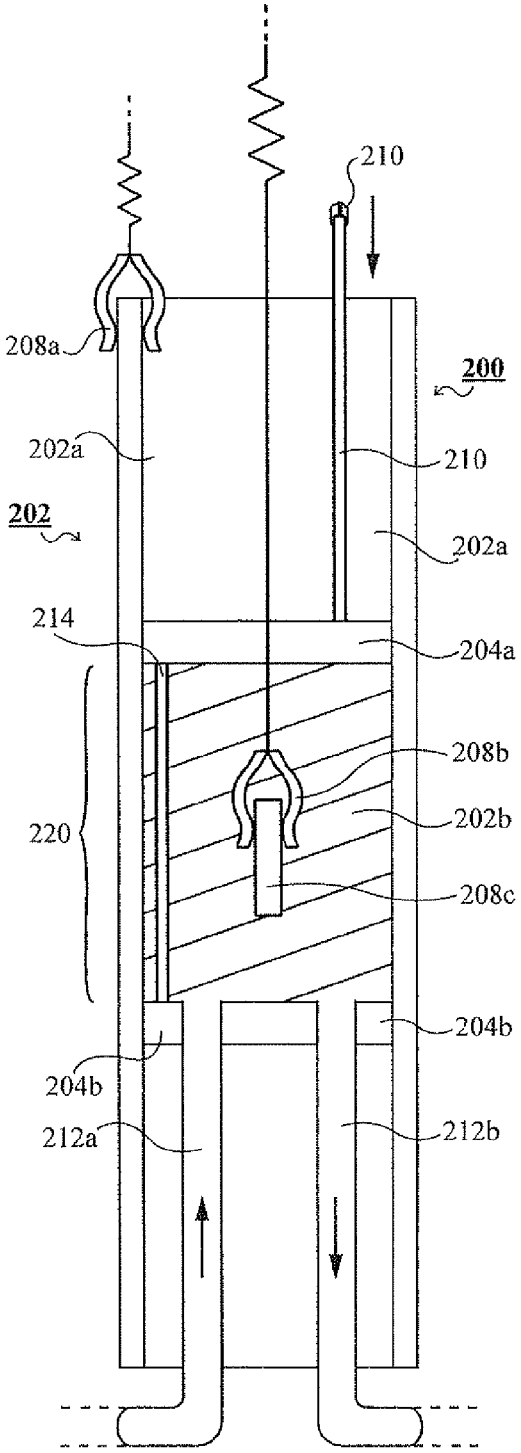
FIG. 2B

ARTICLES FROM MICROARC PROCESSES AND METHODS OF MANUFACTURING SAME

CROSS REFERENCE TO RELATED APPLICATIONS

The present invention claims priority from U.S. Provisional Patent Applications No. 61/361,539 filed Jul. 6, 2010, the content of which is incorporated herein by reference.

FIELD OF THE INVENTION

The invention relates to the field of microarc oxidation (or simply "microarc") in general and to manufacturing articles by microarc oxidation processes in particular.

BACKGROUND OF THE INVENTION

Microarc (or "plasma electrolytic oxidation") is known in the art for processing valve metals (e.g. aluminum, magnesium, titanium, etc.), such as altering external surfaces of articles made of alloys of said metals (or otherwise containing said metals). As microarc processes consume relatively high amounts of energy, a major resource contributing to their costs is electricity, in direct relation to the measurements or dimensions or size of surfaces undergoing such process. Furthermore, the larger the surface that is subjected to a microarc process at any given time—the larger the current density required for the process. Hence, a bigger power supply is necessary for larger surfaces, and so the cost of such a power supply is drastically higher. It is for these reasons that it is extremely difficult or demanding (such as in cost, operation complexity, etc.) to perform microarc processes on very large parts (or "articles"). For articles or parts that are larger than a certain size, it is commercially impossible or impractical to perform microarc processes on their entire surface, or on large sections thereof.

SUMMARY OF THE INVENTION

The invention provides articles (or "parts") which are the products of microarc processes, and methods which facilitate production or manufacturing of said articles. The invention otherwise provides methods of performing microarc processes, or of manufacturing articles by utilizing microarc processes.

An object of the invention is to provide cost-efficient or commercially viable methods for producing or manufacturing articles by utilizing microarc processes. Specifically, said articles may be virtually unlimited in size (i.e. may essentially have any size). Accordingly, in some methods of the invention, only a certain section (or plurality thereof) of an article undergoes a microarc process at any given time. Similarly, some articles of the invention have undergone a microarc process (or plurality thereof), wherein only a certain section (or plurality thereof) of said articles was subjected to said process at any given time. In some methods, an article (or plurality thereof) gradually undergoes a microarc process (or plurality thereof), such that different sections of said articles are sequentially subjected to said process. Similarly, some articles of the invention have gradually undergone a microarc process (or plurality thereof), such that different sections of said articles were sequentially subjected to said process.

Another object of the invention is to provide methods for performing microarc processes on articles which are larger than the largest articles on which it is known in the art that microarc processes are performed. Some articles of the invention can virtually have any size (e.g. tubes of any length), or specifically a dimension of any size. Otherwise, some articles of the invention may be unlimited in size. Similarly, in some methods of the invention, an article (or plurality thereof) which is not limited in size (e.g. size of a specific dimension, such as length) undergoes a microarc process (or plurality thereof).

Another object of the invention is to provide articles which result in a transition between different microarc processes, or between multiple periods of a microarc process. Optionally, said transition may be characterized by change in a solution, or exchange between different solutions, utilized for a microarc process or plurality thereof. The invention further provides methods for producing or manufacturing such articles.

Another object of the invention is to provide tubes (or "pipes") of any length, which may have been subjected to a microarc process (or plurality thereof), for the purpose of being utilized for desalination systems.

Another object of the invention is to provide pulleys which a section thereof (or plurality of sections thereof), such as the groove, may have been subjected to a microarc process (or plurality thereof), for the purpose of superior surface properties of said section.

Another object of the invention is to provide a method to subject an article having any size of external surface (or in other words "surface area"), such as above 30 squared decimeters, or specifically above 60 squared decimeters, without utilizing current density which is above 10 ampere, or more specifically above 100 ampere.

BRIEF DESCRIPTION OF THE SEVERAL VIEWS OF THE DRAWING

The invention is herein described, by way of example only, with reference to the accompanying drawings, wherein:

FIG. 2A shows a perspective view of a contraption of manufacturing of the invention;

FIG. 2B shows a cross-section view of the contraption of manufacturing from FIG. 2A;

The drawings constitute a part of this specification and include exemplary embodiments to the invention, which may be embodied in various forms. It is to be understood that in some instances various aspects of the invention may be shown exaggerated or enlarged to facilitate an understanding of the invention

DETAILED DESCRIPTION OF THE INVENTION

Figure 1A:
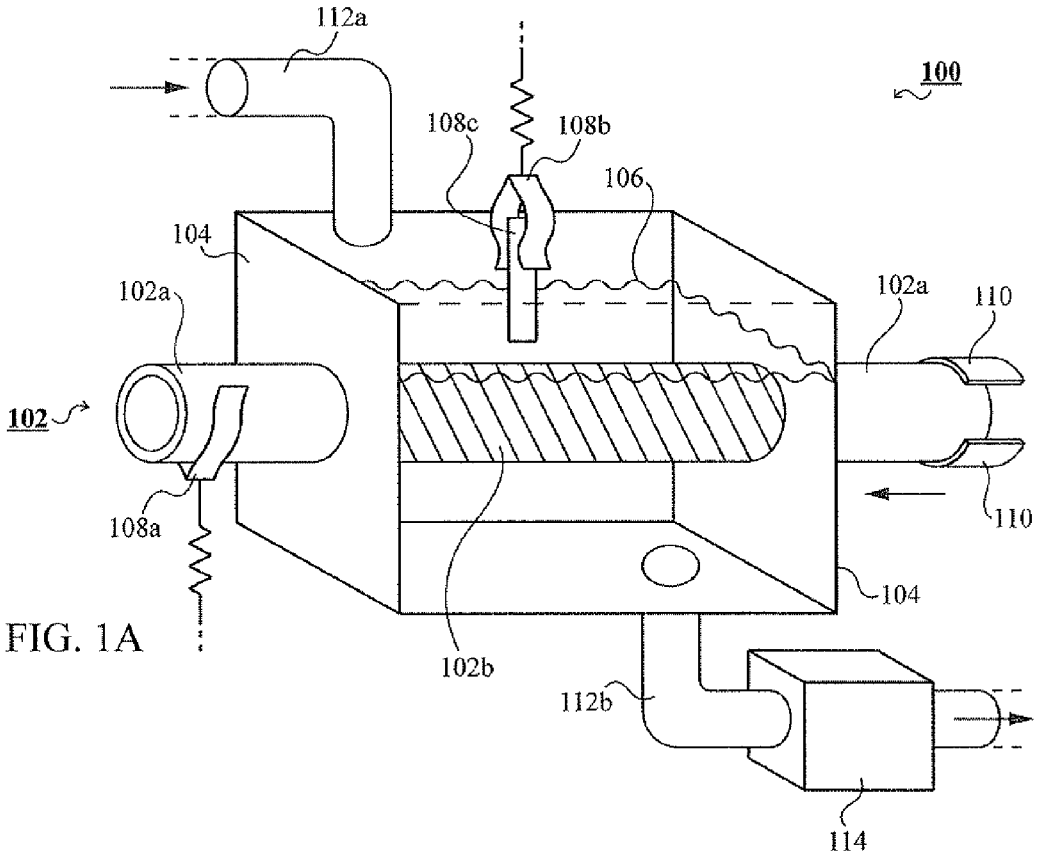
FIG. 1A shows a perspective view of a contraption of manufacturing of the invention.

FIG. 1A shows a perspective view of a contraption 100 in which a tube 102 undergoes (or "is subjected to") a microarc oxidation (or simply "microarc") process. Contraption 100 may be a device or machine or apparatus or system of the invention, which includes a container 104. Tube 102 may be a tube of any length, which may pass through container 104. Specifically, tube 102 may be longer than the length of container 104, whereas a section of the tube may be inside the container and a different section (or plurality thereof) may be outside the container during a microarc process. For example, container 104 may have a length of two meters, whereas tube 102 may have a length of six meters (yet tube 102 may similarly be of any length above six meters), such that a two meter section of the tube may be inside the container. In some methods of the invention, tube 102 may pass through container 104 during a microarc process. In accordance with the last example, a two meter section of tube 102 may be inside the container at a given time of a microarc process (similarly to the shown in FIG. 1A where a section of tube 102 is inside the container), while a different 2 meter section of the tube may be inside the container at a different time.

In FIG. 1A, container 104 is shown containing a solution 106 in which the section of tube 102 which is inside the container is immersed. Solution 106 is the solution in which a microarc process (or plurality thereof) may take place (on the section of tube 102 that is immersed in it). For a microarc process, tube 102 is in contact with a connection 108*a* which connects it to an electric current, essentially making tube 102 an anode. Additionally, a connection 108*b* is in contact with a cathode 108*c* which is dipped in solution 106 (otherwise immersed in it). Accordingly, a microarc process may occur (otherwise be performed) on the surface of the section of tube 102 which is immersed in solution 106 (i.e. the surface of the section is subjected to said microarc process).

In accordance with the shown in FIG. 1A, during a microarc process (and/or before), a solution may be streamed into container 104 through a pipe 112*a*, and drained from container 104 into a pipe 112*b*. In some embodiments of contraption 100, pipe 112*a* and pipe 112*b* are both part of a circulation system for a solution (e.g. solution 106), such as for cooling said solution outside container 104 and streaming it back into container 104. Optionally, said circulation system (i.e. the circulation system including pipes 112*a,b*) further includes a solution modulator 114. Solution modulator may be any part, section, unit or module of contraption 100 which facilitates changing (or "altering") the solution in container 104 (see ref. a solution modulator 400 in FIG. 4A), such that a microarc process (or plurality thereof) utilizes different solutions during different periods. For example, solution 106 may be utilized for a microarc process while passing through a circulation system of contraption 100 (e.g. from container 104 through pipe 112*b*) in which there is solution modulator 114 which may alter solution 106 (e.g. by adding or removing (also "subtracting") a solvent or a solute), whereas the altered solution may then be utilized for a subsequent microarc process or otherwise for a different period of the same microarc process.

For a method for performing a microarc process on tube 102, contraption 100 may include an apparatus 110 (e.g. a robot mechanism) for moving tube 102 through container 104, such as by pushing the tube or pulling the tube. Accordingly, apparatus 110 may facilitates motion of tube 102 such that a different section of the tube is inside container 104 at any given time. Optionally, the movement of tube 102 by apparatus 110 through container 104 is continuous, such that the tube passes through the container during a microarc process (inside solution 106) at a fixed (or "steady") rate (or "pace", or "speed") of motion, or alternatively at a changing rate of motion. For example, apparatus 110 may push tube 102 through container 104 at a rate of half a meter per twenty minutes (i.e. twenty minutes is the period of time in which half a meter of length of tube 102 passes through container 104).

Note that in FIG. 1A there is shown a surface 102*a* of tube 102 (shown in the figure outside container 104) which is not being subjected to a microarc process, and a surface 102*b* (shown in the figure inside container 104, specifically inside solution 106) which is being subjected to a microarc process.

Figure 1B:
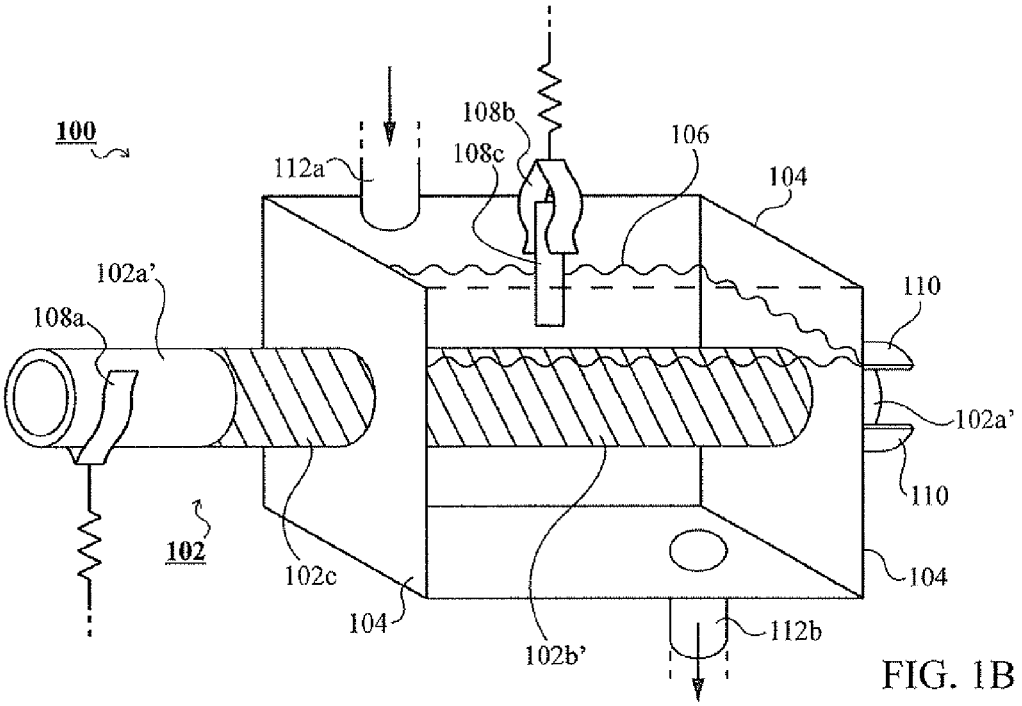
FIG. 1B shows a perspective view of the contraption of manufacturing from FIG. 1A at a different step.

Referring now to FIG. 1B, there is shown contraption 100 at a different step of a method for a microarc process (or plurality thereof) performed on tube 102. In FIG. 1B, tube 102 is shown as pushed from its position in FIG. 1A to a position shown in FIG. 1B, optionally by apparatus 110, as described above. Accordingly, a different surface 102*b*' of tube 102 (as opposed to surface 102*b* as shown in FIG. 1A) is shown inside container 104 and may be undergoing (or "is subjected to") a microarc process inside solution 106. Further accordingly, a different surface 102*a*' of tube 102 (as opposed to surface 102*a* as shown in FIG. 1A) is shown outside container 104, not undergoing a microarc process. Further accordingly, a surface 102*c* (which was inside container 104 when tube 102 was in the position shown in FIG. 1A) is shown in FIG. 1B outside container 104 (e.g. as it has been pushed out of the container), after it has been subjected to a microarc process (when it was inside container 104). Accordingly, surface 102 may be coated by a ceramic coating (e.g. which was generated in the aforementioned microarc process inside container 104).

Following the above, contraption 100 may facilitate subjecting a tube of any length (e.g. 5 meters or above) to a microarc process (or plurality thereof), whereas said tube may be passed (e.g. pushed or pulled by apparatus 110) through a container (e.g. container 104 with solution 106) which is preferably shorter than the length of said tube. Accordingly, any number of sections of said tube may be subjected to a microarc process (or plurality thereof) by gradually or sequentially or continuously passing through said container (inside which occurs a microarc process).

Note that the surfaces of tube 102 shown in FIG. 1A and FIG. 1B and mentioned above are external surfaces of tube 102, whereas the surfaces of a tube 202 (see ref. FIG. 2A and FIG. 2B) shown in FIG. 2A and FIG. 2B and mentioned below refer to internal surfaces of tube 202 (i.e. surfaces inside the tube).

FIG. 2A shows a perspective view of a contraption 200 in which a tube 202 undergoes (or "is subjected to") a microarc process (or plurality thereof). Inside tube 202 are shown (the tube is illustrated such that a gap (referred numerically as gap 201) facilitates view of the inside of the tube, yet it is understood that said gap is merely for the purpose of depiction) panel 204*a* and panel 204*b* which may be any parts (e.g. membranes, walls, etc.) that fit inside the tube to create a closed space between them. Optionally, panels 204*a,b* are connected by a connector 214, such as a rod inside the aforementioned closed space between them.

In the aforementioned closed space between panels 204*a,b* may be a solution (not shown, yet may fill said closed space) for facilitating a microarc process inside said closed space, specifically subjecting a surface of tube 202 that surrounds said closed space (shown a surface 202*b* in FIG. 2A) to said microarc process. Surface 202*b* is subjected to a microarc process (or plurality thereof) as the aforementioned solution inside the closed space between panels 204*a,b* is held (or "enclosed") by the panels and fills said closed space between them. Accordingly, only surface 202*b* of tube 202 may undergo a microarc process while surface 202*b* is of a section of the tube which is bordered (or "defined") by panels 204*a,b* (i.e. while the aforementioned solution filling said closed space is surrounded by surface 202*b* by being held between panels 204*a,b*). Further accordingly, any other surface of the tube (e.g. a surface 202*a* as shown in FIG. 2A) is not subjected to a microarc process while panels 204*a,b* create a closed space surrounded by surface 202*b* (and in which may be a solution necessary for said microarc process).

For a microarc process to occur inside the aforementioned closed space that is between panels 204*a,b* and that is surrounded by surface 202*b*, tube 202 is shown in contact with a connection 208*a* which connects it to an electric current, essentially making tube 202 an anode. Additionally, a cathode 208*c* is located (or "positioned", or "installed") inside the closed space (i.e. between panels 204*a,b*), and accordingly inside a solution that may fill the closed space between panels 204*a,b*. Cathode 208*c* is shown in FIG. 2A attached to a connection 208*b* which connects it to an electric current.

In some embodiments, panel 204*a* is connected to an apparatus 210 which can move panels 204*a,b* inside tube 202 (joint movement may be facilitated by connector 214 connecting the panels) at a fixed or changing pace. For example, apparatus 210 may push panel 204*a* (and optionally also panel 204*b* with it) from one end of tube 202 towards an opposite end. By moving panels 204*a,b*, the closed space between the panels may be surrounded by a surface of a different section of tube 202 (i.e. a different surface at any given time during the moving). Accordingly, a different section of a surface of tube 202 (otherwise a different surface of the tube) may be subjected to a microarc process between panels 204*a,b* at any given time. Optionally, the movement of panels 204*a,b* by apparatus 210 may be steady (i.e. at a fixed speed) so that each section in the path of the movement of the panels may be subjected to a microarc process by a similar duration (or "period of time"). Such movement may be similar to the movement of tube 102 through container 104 of contraption 100 as shown in FIG. 1A and FIG. 1B, and as described above.

Following the above, a section of any length of a surface inside tube 202 may be gradually subjected to a microarc process (or plurality thereof), as panels 204*a,b* move through the tube (i.e. along the inside of the tube), whereas between the panels 204*a,b* may be a closed space in which there may be a solution facilitating said microarc process on a surface of tube 202 that surrounds said closed space (or otherwise that is bordered by the panels).

In some embodiments, a pipe 212*a* is leading (or "streaming") a solution to the closed space between panels 204*a,b*, whereas a pipe 212*b* is draining a solution from said closed space, as shown in FIG. 2A (shown pipes 212*a,b* attached to panel 204*b*). Optionally, pipes 212*a,b* are parts of the same solution-circulating system. As known in the art for microarc processes, a solution-circulating system is sometimes required, such as for cooling a solution (which may be heated during a microarc process). Similarly to the described for contraption 100, a solution modulator (e.g. solution modulator 114 as shown in FIG. 1A and FIG. 1B) may be included in a solution-circulating system which may also includes pipes 212*a,b*, such that a solution inside the aforementioned closed space between panels 204*a,b* may be monitored and/or changed (or "altered", or "modified").

While apparatus 210 is shown and described connected to panel 204*a*, and pipes 212*a,b* are shown connected to panel 204*b*, it is made clear that the scope of the invention is not limited to which panel or how each of the above elements are connected. For example, pipes 212*a,b* and apparatus 210 may be connected to the same panel (e.g. to panel 204*b*).

Referring now to FIG. 2B, there is shown a cross-section view of contraption 200, in accordance with the described above for FIG. 2A. In FIG. 2B there is numbered a space 220 which is a closed space between panel 204*a* and panel 204*b*, such as described above for a closed space between the panels, in which a microarc process (or plurality thereof) may occur, specifically performed on a surface of tube 202 that surrounds space 220 (i.e. that is bordered by panels 204*a,b*; e.g. surface 202*b*). Said microarc process may be facilitated by a solution filling space 220, such as held between panels 204*a,b* and surrounded by surface 202*b*.

Figure 3A:
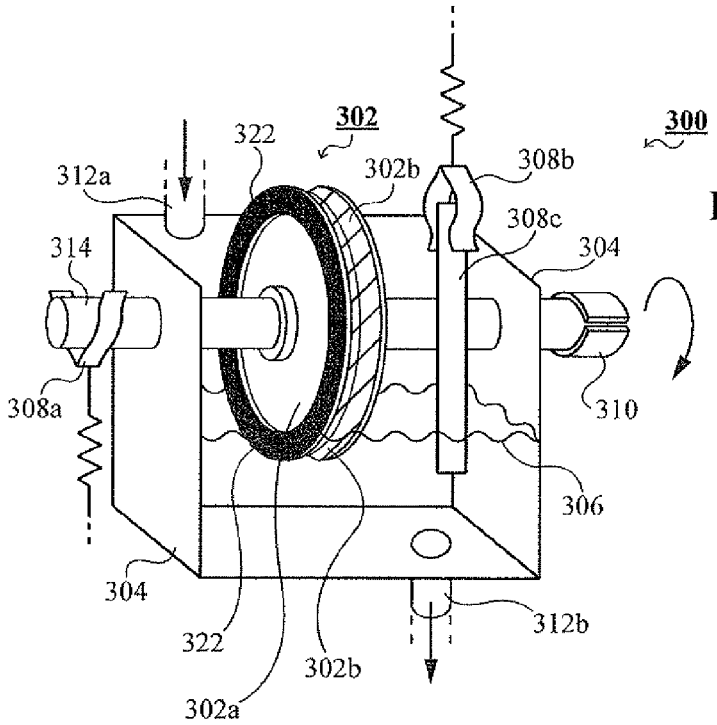
FIG. 3A shows a perspective view of a contraption of manufacturing of the invention.

FIG. 3A shows a perspective view of a contraption 300 in which a pulley 302 undergoes (or "is subjected to") a microarc process (or plurality thereof). More specifically, it may be desired that only the groove of pulley 302 (shown a groove 302*b* in FIG. 3A) will be subjected to a microarc process, whereas the process will be prevented from the rest of the pulley. This may be, for example, for the purpose of reducing cost of manufacturing, such as the cost of the microarc processes required for generating a ceramic coating on groove 302*b* of pulley 302, which may be lower than the cost of generating such a coating on the groove and on the rest of the pulley.

Figure 3B:
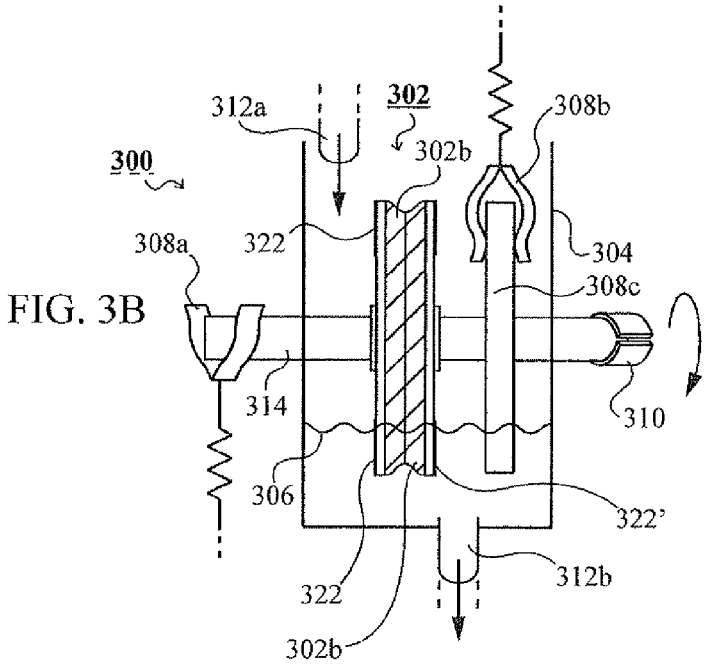
FIG. 3B shows a cross-section view of the contraption of manufacturing from FIG. 3A.

In FIG. 3A, contraption 300 is shown to include a container 304 inside which is a solution 306. Solution 306 fills container 304 up to a certain height, whereas pulley 302 is dipped in the solution to a certain extent. In FIG. 3A there is shown the bottom of pulley 302 dipped in solution 306 such that the bottom of groove 302*b* is immersed in the solution. Additionally, the external surfaces of the bottom of the flanges between which is groove 302*b* may also be immersed in solution 306, yet the pulley is positioned such that its center is outside the solution (and accordingly is not subjected to any microarc process inside the solution). A section of pulley 302 which is not immersed in solution 306 and thus is not subjected to a microarc process is numbered in FIG. 3A as 302*a*. In some embodiments; the external surfaces of the flanges which define groove 302*b* (i.e. the groove is between them) may be covered by covers 322 (one cover 322 is shown in FIG. 3A covering the external surface of one flange, whereas another cover 322' is shown in FIG. 3B in addition to said one cover 322 that is shown in FIG. 3A). Covers 322 may isolate the aforementioned external surfaces of the flanges from any microarc process occurring inside solution 306, so that said external surfaces are prevented from being subjected to said microarc process.

For positioning pulley 302 as described above, it is shown in FIG. 3A pulley 302 hoisted (or "installed") on a rod 314 which is conductive and attached to a connection 308*a* which is a connection to an electric current, thus connecting pulley 302 to an electric current and essentially making it an anode. However, it is made clear that hoisting pulley 302 on a rod does not limit the scope of the invention to only such a construction or way for dipping pulley 302 in solution 306 to a certain extent (i.e. not fully immersing the pulley in the solution).

Similarly to the described above for other contraption of the invention, contraption 300 may include a cathode 308*c* which may be dipped in solution 306 and attached to a connector 308*b* which connects it to an electric current, thus facilitating a microarc process inside the solution. Further similarly to the described above, contraption 300 may include a pipe 312*a* which streams a solution into container 304, and a pipe 312*b* which drains a solution (optionally the same solution) from the container.

In some embodiments, rod 314 may be connected to an apparatus 310 which rotates it, whereas pulley 302, as hoisted on the rod, rotates respectively. For example, apparatus 310 may be a robot which rotates rod 314 and accordingly pulley 302 as it is hoisted on rod 314. By rotating pulley 302, a different section of the surface of groove 302*b* is immersed by solution 306 at any given time, and so a different section of the surface of the groove may be subjected to a microarc process at any given time. Accordingly, the surface of groove 302*b* may gradually undergo a microarc process (or plurality thereof), such as by rotating pulley 302 and thus having sections of the surface of the groove sequentially immersed in solution 306 (where a microarc process may occur). For example, apparatus 310 may rotate rod 314 and respectively pulley 302 at a steady or changing pace such that a different section of the surface of groove 302*b* is immersed in solution 306 at any given moment, thus a different section of the surface of the groove is subjected to a microarc process in the solution at any given moment (or "at any given time").

In some embodiments and in some methods, an entire rotation (i.e. of 360 degrees) of pulley 302 (e.g. by apparatus 310) may repeat itself such that different sections of the surface of groove 302*b* are repeatedly immersed in solution 306, thus undergoing a microarc process (or plurality thereof) multiple times. Note that from our findings, in some cases, such a repetition does not have a substantial (or any) effect of the continuity of the coating on a groove of a pulley resulted from a microarc process as described herein. For example, it may be difficult to distinguish between a surface of a groove of a pulley which has been completely immersed in a solution during a microarc process and a surface of a groove of a pulley which was dipped in a solution and rotated in accordance with the described above.

In FIG. 3A, similarly to the described for contraption 100 and contraption 200 regarding streaming of solution and draining of solution, contraption 300 may include a pipe 312*a* which streams solution into container 304, and a pipe 312*b* which drains solution from container 304.

Referring now to FIG. 3B, there is shown a cross-section view of contraption 300, in accordance with the described above for FIG. 3A.

Figure 3C:
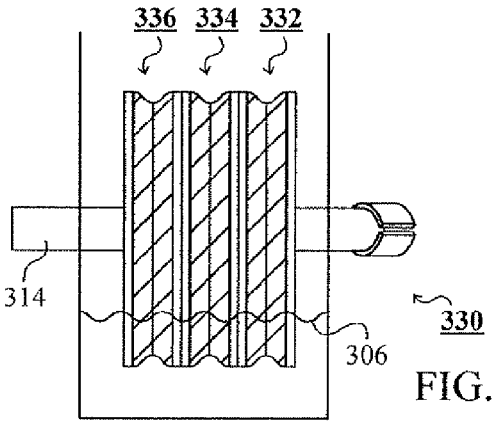
FIG. 3C shows a cross-section view of a contraption similar to the contraptions shown in FIGS. 3A & 3B.

Referring now to FIG. 3C, there is shown a cross-section view of a contraption 330, similar to the described above for contraption 300 (certain elements of contraption 300 are not shown in FIG. 3C yet it is made clear that they may be included in contraption 330). In contraption 330, a pulley 332, a pulley 334 and a pulley 336 are joined together (e.g. physically attached as they are installed on rod 314), and also dipped in solution 306, such that only the surface of their grooves is exposed to the solution, whereas the external surface of the flanges of said grooves is not exposed to the solution (e.g. by being tightly attached to the external surface of flanges of another pulley's groove). However, the external surface of one of the flanges of the groove of pulley 332 and the external surface of one of the flanges of the groove of pulley 336 may be exposed to the solution, as shown in FIG. 3C. Alternatively, the external surface of one of the flanges of the groove of pulley 332 and the external surface of one of the flanges of the groove of pulley 336 may be covered by covers 322 (e.g. one by cover 322 and another by cover 322'), such as shown in FIG. 3B the external surface of the flanges of groove 302*b* covered by covers 322 (i.e. the surface of one of the flanges by cover 322, and the surface of the other flange by cover 322').

Figure 4A:
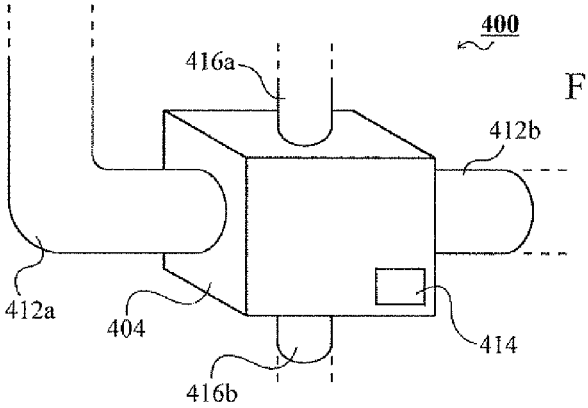
FIG. 4A shows a solution modulator of the invention.

In FIG. 4A there is shown a solution modulator 400, similar to solution modulator 114 in FIG. 1A. Accordingly, solution modulator 400 facilitates any change of a solution, or exchange between solutions. Optionally, solution modulator 400 includes a container 404 in which changes (or "alterations", or "modifications") in a solution occur, or in which one solution is exchanged by another solution. A solution which was or is utilized for (or "took part in") a microarc process may be streamed to container 404 through a pipe 414*a*, whereas a modified solution (or a different solution) may be streamed out of (or "drained from") container 404 through a pipe 414*b*. Pipes 414*a,b* may be part of a solution-circulation system of a contraption of the invention or of any contraption for microarc oxidation processes. Optionally, solution modulator 400 may include a monitor 414 for obtaining information about a solution inside container 404. For example, monitor 414 may check which temperature a solution is at, and/or which pH. Accordingly, for the same example, solution modulator 400 may change the temperature and pH of said solution, such as by utilizing a cooling system or unit or module, and/or by adding any amount of a certain substance to a solution (e.g. more of the solvent or more of the solute of the solution).

In some embodiments, solution modulator 400 may facilitate changing a solution for a microarc process (or plurality thereof), or a part (or "period") thereof, such that a microarc process, or plurality thereof, may utilize different solutions, or otherwise be composed of periods at each of which a different solution is utilized (i.e. an article is immersed in different solutions in different periods of a microarc process). For example, a first solution may be utilized for subjecting an article to a microarc process (e.g. said article may be immersed in said solution, in a contraption that facilitates microarc processes), whereas said first solution may be streamed to solution modulator 400 (e.g. through pipe 412*a*), whereat it may undergo changes or replaced altogether by a second solution. Said second solution (or the changed first solution) may then be streamed from solution modulator 400 (e.g. through pipe 412*b*) to be utilized for a microarc process which the same aforementioned article may undergo subsequently. For a more specific example, a certain contraption (e.g. contraption 100) may include solution modulator 400, whereas a tube (e.g. tube 102), or a section thereof, may undergoe a microarc process in a container (e.g. container 104) filled with a solution (e.g. solution 106) which includes a first pigment solute. After a certain period of time, said solution may be added a second pigment solute by solution modulator 400, such as by said first solution passing through solution modulator 400 (e.g. in a circulation system) and being streamed back to said container (of the aforementioned contraption) in which a microarc process may be performed. Accordingly, said microarc process may be composed of two periods, in the first of which there is present said first pigment solute, whereas in the second of which there is present said second pigment solute (in addition to, or substituting, said first pigment solute).

In some embodiments, changes in a solution or exchanges between solutions, may be facilitated by s faucet 416*a* and/or by a filter 416*b*, as shown in FIG. 4A, or by any means known in the art.

Following the above, a solution modulator of the invention (e.g. solution modulator 400) may facilitate any change (or "modification", or "alteration") of a solution for a microarc process, or plurality thereof, and/or any replacing (or "switching", or "swapping", or "exchanging") between two or more solutions for a microarc process, or plurality thereof. Otherwise, a solution modulator of the invention may be any part (or "unit", or "module") of a contraption or device or apparatus or system for subjecting articles to microarc processes, whereas said solution modulator may facilitate any change in a solution, or any exchanging of solutions, for microarc processes performed by said contraption or device or apparatus or system. It is made clear that a solution modulator of the invention may facilitate change in a solution, or exchanging of solutions, during a microarc process, or otherwise while a microarc process occurs, or at any period along the duration of a microarc process. Accordingly, any changing or exchanging as described above may be transitional or gradual.

While solution modulator 400 may be shown in FIG. 4A and described by the above, it is made clear that a solution modulator of the invention may be any apparatus or device or system, or part or unit or module thereof, which may, by any means known in the art, change (or "alter", or "modify") a solution of a microarc process, or exchange solutions of a microarc process (i.e. replace one solution by another). Otherwise, it is made clear that a solution modulator of the invention may change a solution utilized for any microarc process, or plurality thereof, or switch between solutions utilized in different periods of any microarc process. More specifically, it is made clear that the scope of the invention includes any device, apparatus, contraption or system, or unit, part or section thereof, which may be utilized in a microarc process (or plurality thereof) to modify a solution in which said microarc process occurs (or "is performed"), or exchange solutions during said microarc process (by any means known in the art). For example, a microarc process may occur inside a container filled with a first solution, whereas a solution modulator of the invention may stream additional solutes into said first solution, optionally during said microarc process. Alternatively, a solution modulator of the invention may gradually drain said first solution while gradually stream a second solution into said container.

Following the above, some methods of the invention may include steps in which different solutions may be utilized in (or "for") the same microarc process, or may include steps of changing a solution (or switching between solutions) during a microarc process, or plurality thereof. Accordingly, some articles of the invention may include a coating which is a result of a microarc process for which (or "in which") different solutions were utilized, or for which modifications were made in a solution that was utilized to subject an article (or plurality thereof) to said microarc process.

Figure 4B:
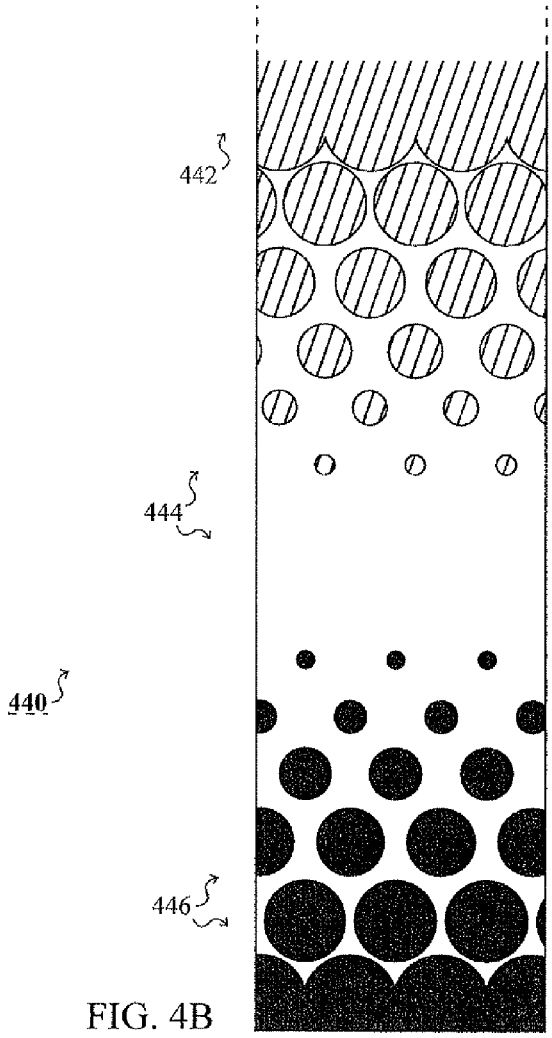
FIG. 4B shows a cross section of an article of the invention.

In FIG. 4B there is shown a cross-section view of a surface of an article 440 (generally, the face of the article is shown at the bottom of the figure, whereas towards the top of the figure is the inside of the body of the article), whereas said article was subjected to a microarc process composed of two periods, the first of which was performed in a first solution, whereas the second of which was performed in a second solution. Article 440 may have originally been made of a material 442 (e.g. aluminum), whereas after the aforementioned microarc process—material 442 generally makes the internal volume of article 440 (i.e. the inside of the body of the article which was not subjected to any microarc process). As shown in FIG. 4B, a material 444 (e.g. alumina) may have been formed on (otherwise "out of") material 442 during the first period of said microarc process which was performed in said first solution. Additionally, a material 446 (e.g. alumina containing a pigment) may have been formed on (otherwise "out of") material 444 during the second period of said microarc process which was performed in said second solution. Optionally, material 446 was additionally formed from matter in said second solution, such as from a pigment solute (in addition to matter from material 444). As shown in FIG. 4B, materials 442, 444 and 446 may not be exactly defined as layers, yet may exhibit a transition (e.g. a gradient pattern) in article 440, in accordance with a gradual exchange between the aforementioned first solution and the aforementioned second solution in the aforementioned microarc process.

Following the above, a surface of an article of the invention (up to a certain depth inside the volume of said article) may be made of several layers, or of a transition pattern of several materials (e.g. a gradient of compositions of materials), which were formed during different periods of a microarc process in which different solutions were utilized. Said different periods may have been phased into each other gradually (or by any transition sequence), such as in case said different solutions were switched from one into another gradually.

Note that while the described herein refers to microarc oxidation (or "plasma electrolytic oxidation"), similarly within the scope of the invention are related processes, such as plasma electrolytic nitriding, plasma electrolytic carburizing, plasma electrolytic boriding, plasma electrolytic carbonitriding, etc.

While the described herein is for certain embodiments of devices of the invention featuring certain elements, it will be appreciated that other embodiments may be included in the scope of the invention which feature different combinations of elements described herein, and their equivalences as known in the art.

While the invention has been described with respect to a limited number of embodiments, it will be appreciated that many variations, modifications and other applications of the invention may be made.

The invention claimed is:

1. A method of providing plasma electrolytic oxide coating to a valve metal article, comprising the steps of:

a) exposing a first section of the entire surface area of said valve metal article to an electrolyte by i) inserting the first section into a first electrolyte bath and inserting a second electrolyte bath inside said valve metal article, or ii) inserting the second electrolyte bath inside said valve metal article;

b) inducing a first localized plasma reaction on the exposed first section;

c) extracting said first section of the entire surface area from said electrolyte by i) removing the second electrolyte bath inside said metal valve article from the first section and removing the first section from the electrolyte bath or ii) removing the second electrolyte bath inside said metal valve article from the first section;

d) exposing a second section of the entire surface area of said valve metal article to said electrolyte by at least one of i) inserting the second section into the first electrolyte bath and ii) moving the second electrolyte bath inside said valve metal article; and e) inducing a second localized plasma reaction on the exposed second section, wherein inserting a second electrolyte bath inside said valve metal article comprises inserting a structure that, in combination with the valve metal article forms a closed space holding the second electrolyte bath inside said valve metal article and wherein removing the second electrolyte bath inside said metal valve article from the first section comprises moving the closed space holding the second electrolyte bath inside said valve metal article.

2. The method of claim 1, wherein the structure comprises end panels which form the closed space together with the first section during induction of the first localized plasma reaction.

3. The method of claim 1, wherein said exposing of said second section is sequential to said exposing of said first section.

4. The method of claim 3, wherein there is no time in between the first and the second localized plasma reactions.

5. The method of claim 1, wherein said first section and said second section have the same length.

6. The method of claim 1, wherein said first section and said second section have the same surface area.

7. The method of claim 1, wherein said first section and said second section have a common area.

8. The method of claim 1, further comprising adding new solution into the first and/or second electrolyte bath through a first pipe and draining used solution from the first and/or second electrolyte bath through a second pipe.

9. The method of claim 8, further comprising altering the first and/or second electrolyte bath between the first and the second localized plasma reactions by adding and/or removing a solvent and/or solute via a solution modulator.

10. The method of claim 9, further comprising obtaining information about the first and/or second electrolyte bath via a monitor of the solution modulator and at least one of: adjusting temperature of the first and/or second electrolyte bath, adjusting pH of the first and/or second electrolyte bath, and adding a substance to the first and/or second electrolyte bath via the solution modulator.

11. A method of providing plasma electrolytic oxide coating to a valve metal article, comprising the steps of:

a) exposing a first section of the entire surface area of said valve metal article to an electrolyte by i) inserting the first section into a first electrolyte bath or ii) inserting the first section into the first electrolyte bath and inserting a second electrolyte bath inside said valve metal article;

b) inducing a first localized plasma reaction on the exposed first section;

c) extracting said first section of the entire surface area from said electrolyte by i) removing the first section from the electrolyte bath or ii) removing the first section from the electrolyte bath and removing the second electrolyte bath inside said metal valve article from the first section;

d) exposing a second section of the entire surface area of said valve metal article to said electrolyte by at least one of i) inserting the second section into the first electrolyte bath and ii) moving the second electrolyte bath inside said valve metal article; and e) inducing a second localized plasma reaction on the exposed second section, wherein inserting the first section into a first electrolyte bath comprises rotating the valve metal article about an axis and wherein removing the first section from the electrolyte bath comprises rotating the valve metal article about the axis.

12. The method of claim 11, wherein rotating the valve metal article about an axis comprises rotating a pulley on its axis, the valve metal article located in a groove of the pulley, a portion of the pulley being immersed in the first electrolyte bath.

13. The method of claim 11, wherein said exposing of said second section is sequential to said exposing of said first section.

14. The method of claim 13, wherein there is no time in between the first and the second localized plasma reactions.

15. The method of claim 11, wherein said first section and said second section have the same length.

16. The method of claim 11, wherein said first section and said second section have the same surface area.

17. The method of claim 11, wherein said first section and said second section have a common area.

18. The method of claim 11, further comprising adding new solution into the first and/or second electrolyte bath through a first pipe and draining used solution from the first and/or second electrolyte bath through a second pipe.

19. The method of claim 11, further comprising altering the first and/or second electrolyte bath between the first and the second localized plasma reactions by adding and/or removing a solvent and/or solute via a solution modulator.

20. The method of claim 19, further comprising obtaining information about the first and/or second electrolyte bath via a monitor of the solution modulator and at least one of: adjusting temperature of the first and/or second electrolyte bath, adjusting pH of the first and/or second electrolyte bath, and adding a substance to the first and/or second electrolyte bath via the solution modulator.

* * * * *